United States Patent [19]

Matsuda et al.

[11] Patent Number: 4,877,183

[45] Date of Patent: Oct. 31, 1989

[54] AIR FLOW CONTROL DEVICE FOR AN AIR CONDITIONER

[75] Inventors: Kenji Matsuda; Kenji Togashi; Hiroyuki Umemura; Tetsuji Okada; Hidenori Ishioka; Katsuyuki Aoki, all of Shizuoka, Japan

[73] Assignee: Mitsubishi Denki Kabushiki Kaisha, Tokyo, Japan

[21] Appl. No.: 246,269

[22] Filed: Sep. 19, 1988

[30] Foreign Application Priority Data

Sep. 22, 1987 [JP] Japan ..... 62-238405

[51] Int. Cl.[4] ..... F24F 13/00

[52] U.S. Cl. ..... 236/49.3; 62/186; 98/42.04; 165/40

[58] Field of Search ..... 236/49 D; 62/186; 98/94 AC, 42.04, 42.02; 165/40

[56] References Cited

U.S. PATENT DOCUMENTS

| | | | |
|---|---|---|---|
| 2,552,966 | 5/1951 | Harp | 236/49 D X |
| 3,653,590 | 4/1972 | Elsea | 236/49 D |
| 3,684,190 | 8/1972 | Roof | 236/49 D X |
| 4,003,729 | 1/1977 | McGrath | 62/186 X |
| 4,571,950 | 2/1986 | Nariai et al. | 236/49 D X |
| 4,734,012 | 3/1988 | Dob et al. | 236/49 D X |

FOREIGN PATENT DOCUMENTS

| | | |
|---|---|---|
| 59-191842 | 10/1984 | Japan . |
| 61-38383 | 8/1986 | Japan . |

*Primary Examiner*—William E. Tapolcai

*Attorney, Agent, or Firm*—Oblon, Spivak, McClelland, Maier & Neustadt

[57] ABSTRACT

An air flow control device for an air conditioner increases the revolution of a fan motor to the revolution wherein the short cycle does not occur, or change the direction of an air directing plate to a preset angle wherein the short cycle does not occur when information corresponding to the short cycle is detected based on the air flowing direction from the outlet port or an intake air temperature. As a result, the short cycle can be prevented, and effective heat exchanger and effective air conditioning wherein temperature distribution in a room to be air-conditioned is not deteriotated are obtained.

12 Claims, 7 Drawing Sheets

AIR FLOW CONTROL DEVICE FOR AN AIR CONDITIONER

The present invention relates to an air flow control device for an air conditioner, in particular to an air flow control device for controlling outlet air so that a short cycle does not occurs in the outlet air.

FIG. 15 is a vertical cross-sectional view showing a conventional air conditioner as disclosed in e.g. Jaaanese Examined Patent Publication No. 38383/1986.

In FIG. 15, reference numeral 1 designates an indoor unit main body of the air conditioner, which is formed with outlet ports 2 and 3 in an upper portion and a lower portion, respectively. At a central portion of the front surface of the indoor unit main body in the vertical direction, an intake port 4 is formed. Reference numerals 5 and 6 designate an upper and lower air blowing fans, which are arranged in the indoor unit main body 1 so as to face the upper and lower outlet ports 2 and 3, respectively. Reference numeral 7 designates an indoor heat exchanger which is arranged in the indoor unit main body 1 so as to face the intake port 4. The indoor heat exchanger constitutes a well-known refrigerating cycle together with a compressor and an outdoor heat exchanger (both not shown), and serves as an evaporator on cooling and as a condenser on heating.

Reference numeral 8 designates an air filter which is placed in the intake port 4. Reference numerals 9 and 10 designate fan cases which are placed around the upper blowing fan 5 and the lower blowing fan 6, respectively.

Now, the operation of the air conditioner will be explained.

When the upper and lower fans 5 and 6 are driven simultaneously, conditioned air is blown off from both outlet ports 2 and 3. If the fans 5 and 6 are rotated at a high speed, the outlet air can reach a position far from the air conditioner in a room to be air-conditioned. On the other hand, if the fans 5 and 6 are switched to a low speed, the outlet air is sent to a position close to the air-conditioner.

After such conditioned air supplying operation is repeated several times, or the upper and lower fans 5 and 6 are switched to the low speed revolution, both fans 5 and 6 can be halted for a predetermined time as required.

In addition, only the upper fan 5 is driven under variable speed control. Conversely, only the lower fan 6 can be driven under variable speed control.

The air flow control as described above allows the air in the room to be struck each other from the upper and lower directions. As a result, the conditioned air is distributed through out the room, thereby making temperature distribution in the room uniform. In addition, since an user feels cooled air or heated air intermittently, he or she is prevented from being acclimated to the conditioned environment even if he or she stays in the room for a long time. As a result, effective air conditioning service can be always felt, thereby realizing effective air conditioning effect.

The conventional air conditioner as described above has a problem wherein the feeding direction of the conditioned air and the air flow control are restricted because the intake port 4 is positioned between the upper and lower outlet ports 2 and 3. Specifically, there is no problem if the flowing direction of the conditioned air from the outlet ports 2 and 3 in the indoor unit main body 1 is the directions indicated by arrows a and b, or the flow rate of the conditioned air is great and the flow direction of the conditioned air is in the directions as indicated by arrows c and d as shown in FIG. 16.

However, when the flow rate of the conditioned air is small, there may take place the short cycle wherein the conditioned air as blown off is sucked into the intake port 4 immediately as indicated by arrows e and f in FIG. 16 even if the flow directions of the conditioned air are the ones as indicated by c and d. As a result, there are problems wherein temperature distribution in the room and air conditioned environment are deteriorated and effective heat exchange is prevented.

The short cycle may occur not only in the air conditioner of a type wherein the outlet ports are formed in the upper and lower portions as shown in FIG. 15, but also an air conditioner with a single outlet port.

It is an object of the present invention to eliminate such problems, and to provide an air flow control device for an air conditioner wherein the short cycle of the outlet air can be prevented, and effective heat exchange and effective temperature distribution in the room can be realized.

The foregoing and the other objects of the present invention have been attained by providing an air flow control device for an air conditioner comprising detecting means for detecting information corresponding to the short cycle based on the flow direction of the outlet air from an outlet port or an intake air temperature, and fan motor speed adjusting means for changing the revolution of a fan motor or air directing plate adjusting means for controlling the direction of an air directing plate based on the output signal from the detecting means.

In accordance with the present invention, the fan motor speed adjusting means or the air directing plate adjusting means which has received the output signal from the detecting means controls the fan motor so as to increase the revolution of the fan motor to the revolution wherein the short cycle does not occur, or changes the angle of the air directing plate to a preset angle wherein the short cycle does not occur. As a result, the short cycle of the outlet air can be prevented, and effective heat exchange and effective air conditioning wherein temperature distribution in the room can not be prevented from deteriorating can be realized.

The present invention will be described in detail in reference to the accompanying drawings.

Firstly, a first embodiment of the air conditioner air flow control device according to the present invention will be explained in reference to FIGS. 1 through 5.

Figure 1:
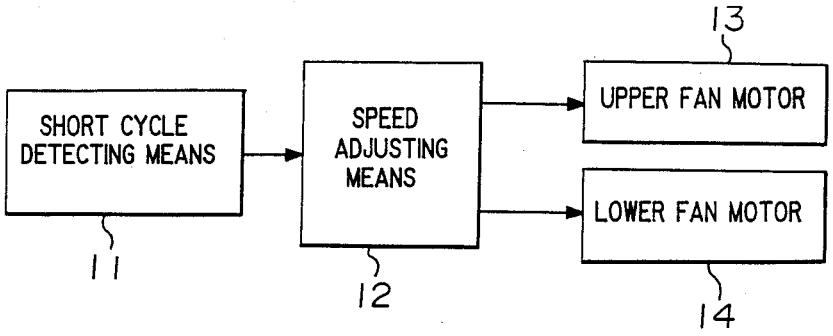
FIG. 1 is a functional block diagram to explain the principle of the air flow control device according to the present invention.

FIG. 1 is a block diagram to explain the principle of the air flow control device.

As seen from FIG. 1, speed adjusting means 12 controls an upper fan motor 13 and a lower fan motor 14 based on the output from short cycle detecting means 11.

Figure 2:
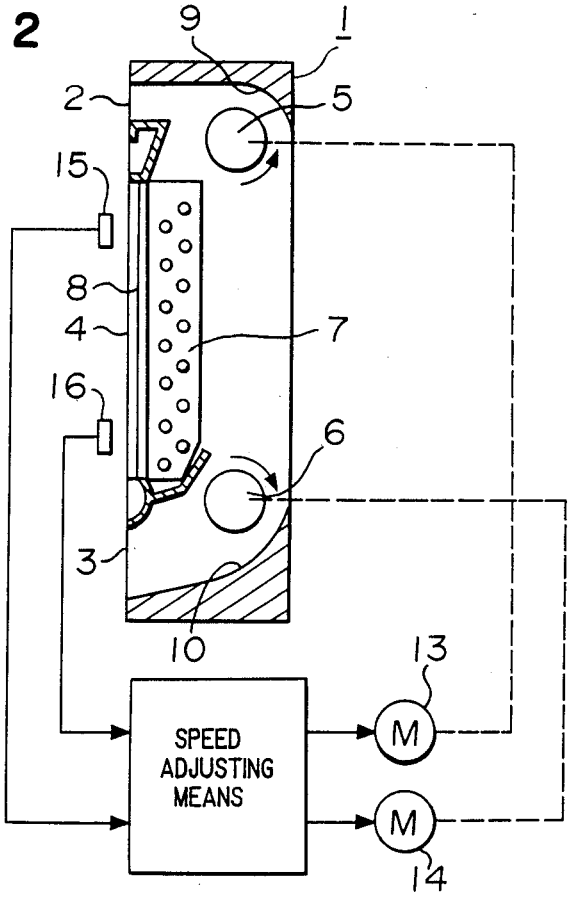
FIG. 2 is a diagram showing the whole arrangement of a first embodiment according to the present invention.

FIG. 2 is a diagram showing the whole arrangement of the first embodiment wherein the air flow control principle according to the present invention is applied.

In FIG. 2, an indoor unit main body 1 includes an upper and lower outlet ports 2 and 3, an intake port 4, an upper and lower fans 5 and 6 arranged so as to face the upper and lower outlet ports 2 and 3 respectively, an indoor heat exchanger 7 arranged behind the intake port 4, an air filter 8 placed in front of the intake port 4, and fan cases 9 and 10 for the upper and lower fans 5 and 6, like the conventional air conditioner.

There are intake air temperature detectors 15 and 16 at an upper and lower portions of the intake port 4, respectively. The intake air temperature detectors 15 and 16 detect the temperature of the air which is suck into the upper and lower portions of the intake port 4, thereby finding whether the outlet air blown off from the upper and lower outlet ports 2 and 3 is suck into the intake port 4 in the short cycle. When the outlet air is in the short cycle, each intake air temperature sensor 15 or 16 detects a temperature that is near the temperature of the outlet air, i.e. that can not be considered to be a normal room temperature, and outputs an "ON" signal.

Figure 3:
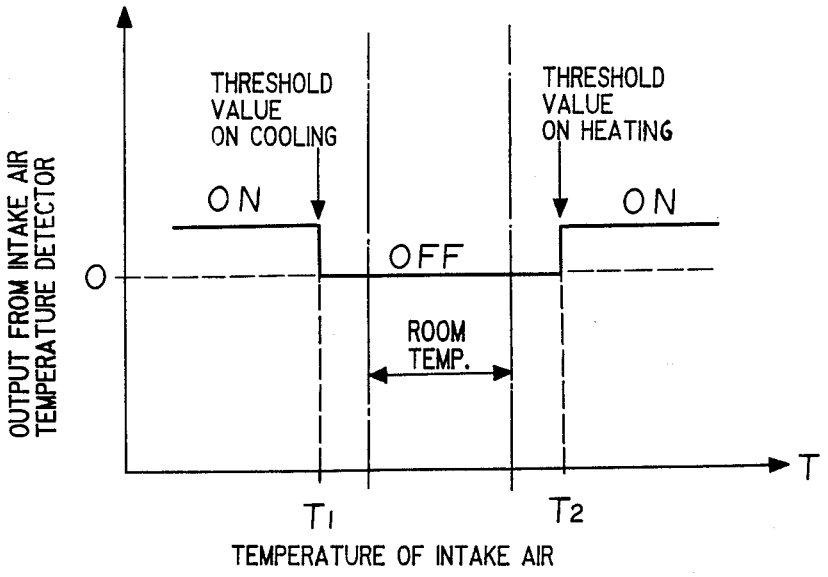
FIG. 3 is a graphical representation showing the relation between an intake air temperature and the output signal from a temperature detector in the first embodiment.

FIG. 3 is a graphical representation showing the relation between the temperature T of the intake air and the output from the intake air temperature detectors. A "threshold value $T_1$ on cooling" (hereinbelow, referred to as a set temperature $T_1$) and a "threshold value $T_2$ on heating" (hereinbelow, referred to as a set temperature $T_2$) as indicated in FIG. 3 are preset when the air conditioner is manufactured.

For example, on heating, when the intake air temperature T is raised beyond the set temperature $T_2$, it is judged that there is a strong possibility that the outlet air is in the short cycle. As a result, the output of the intake air temperature detectors is reversed from OFF to ON. On cooling, when the intake air temperature T is lower beyond the set temperature $T_1$, the same judgement is made, and the output of the detector is reversed from OFF to ON.

The output from the upper and the lower intake air temperature detectors 15 and 16 is input to the speed adjusting means 12 as shown in FIG. 1. The speed adjusting means 12 controls the revolution speed of the fans based on the output from the detectors 15 and 16 so that the short cycle does not occur. The speed adjusting means 12 is connected to the fan motors 13 and 14 which drive the upper and lower fans 5 and 6 respectively.

Figure 4:
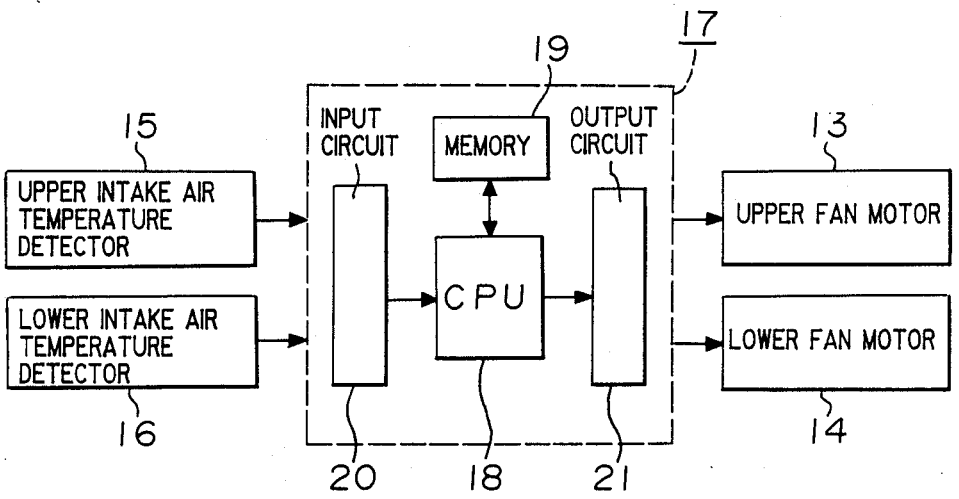
FIG. 4 is a block diagram showing an example of speed adjusting means in the first embodiment.

FIG. 4 is shown an example wherein the speed adjusting means 12 is constituted by a microcomputer 17.

In FIG. 4, the microcomputer 17 constituting the speed adjusting means comprises a central processing unit (hereinbelow, referred to as CPU) 18 for controlling the entire system, memory 19 for storing a program for fan motor speed adjusting procedure and other data, an input circuit 20 for transmitting the output signals of the upper and lower intake air temperature detectors 15 and 16 to the CPU 18, and an output circuit 21 for outputting the data processed by the CPU 18 to the upper and lower fan motors 13 and 14.

Figure 5:
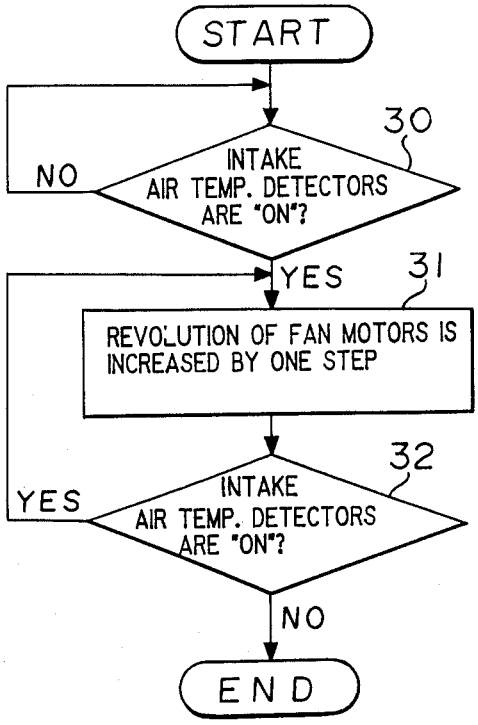
FIG. 5 is a flow chart showing speed adjusting procedure in the adjustable speed adjusting means.

The operation of the air flow control device of the first embodiment as constructed above will be explain in reference to a flow chart as shown in FIG. 5.

When the air conditioner starts heating or cooling, the upper and lower fans 5 and 6 are rotated at revolution speed corresponding to the heating or a cooling load. As a result, the air in a room to be air-conditioned is suck from the intake port 4, and it is heat-exchanged while it is passing through the heat exchanger 7. After that, the conditioned air is blown off from the outlet ports 2 and 3 into the room to air-condition the inside of the room.

The operation of the air conditioner starts the program as shown in FIG. 5. Firstly, at a step 30, it is monitered whether the intake air temperature detectors 15 and 13 are "ON" or not. If the short cycle condition wherein a part of the outlet air blown off from the outlet ports 2 and 3 turns to the intake port 4 is caused by e.g. switching the fans 5 and 6 to a low revolution, the presence of the outlet air in the short cycle is detected by the intake air temperature detectors 15 and 16. If the detected intake air temperature is the set temperature $T_2$ or above (on heating) or the set temperature $T_1$ or below (on cooling) for the temperature detectors 15 and 16 at that time, the detectors 15 and 16 output an ON signal indicating that there is a strong possibility that the short cycle occurs in the outlet air. The ON signal is received into the CPU 18 through the input circuit 20 to increase the revolution of the fan motors 13 and 14 by one step according to the program for fan motor speed adjusting procedure stored in the memory (at a step 31). And the processing proceeds to the next step 32, where it is judged again whether the intake air temperature detectors 15 and 16 output the ON signal or not. When the ON signal is output at that time, the processing is returned to the step 31, where the revolution of the fan motors 13 and 14 is increased by one more step. The same procedure is repeated to increase the revolution of the fan motors 13 and 14 by one step until the intake air temperature detectors 15 and 16 become off, i.e. it is judged that the short cycle of the outlet air has ended. When the intake air temperature detectors 15 and 16 become off, the procedure for treating the short cycle in the outlet air terminates.

In accordance with the first embodiment of the present invention, it is judged by the intake air temperature detectors 15 and 16 whether the outlet air is in the short cycle. When the outlet air is considered to be in the short cycle, the revolution of the fan motors 13 and 14 is automatically changed to be increased, thereby eliminating the short cycle. As a result, the temperature distribution in the room can be prevented from deteriorating, thereby maintaining effective heat exchange.

By the way, there is a stronger possibility that the conditioned air blown off out of the lower outlet port is in the short cycle on heating in comparison with the conditioned air blown off from the upper outlet port 2 because heated air, i.e. air lighter than the air in the room, is blown off from the outlet ports. As a result, even if only the lower intake air temperature detector 16 is activated on heating to control both upper and lower fan motors 13 and 14, or only the lower fan motor 14 is operated based on the output signals from the intake air temperature detector 16, it is possible to prevent the short cycle effectively.

On the other hand, there is a stronger possibility that the conditioned air blown off from the upper outlet port is in the short cycle on cooling in comparison with the air blown off from the lower outlet port 2 because cooled air, i.e. air heavier than the air in the room is blown off from the outlet ports. As a result, even if only the upper intake air temperature detector 15 is activated on cooling to control both upper and lower fan motors 13 and 14, or only the upper fan motor 13 is controlled based on the upper signal from the upper intake air temperature signal detector 15, it is possible to avoid the short cycle effectively.

Although each fan motor is provided for each outlet port in the first embodiment, the upper and lower outlet ports do not necessarily need to the respective fan motors.

Figure 6:
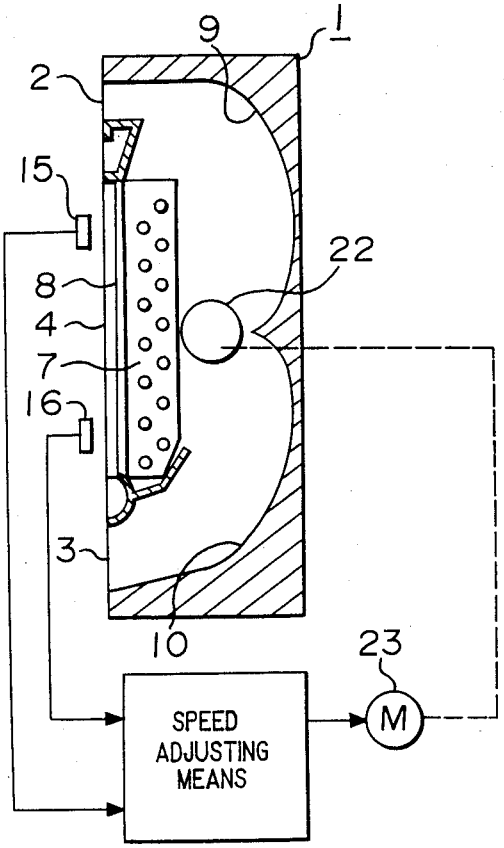
FIG. 6 is a diagram showing the whole arrangement of a second embodiment according to the present invention.

FIG. 6 is a second embodiment of the present invention. In FIG. 6, reference numeral 22 designates a central fan which is arranged in the middle between the upper and lower outlet ports Reference numeral 23 designates a central fan motor for driving the central fan.

The same reference numerals as FIG. 1 indicate similar or corresponding parts, and the explanation on these parts is omitted for the sake of clarity The speed adjusting procedure for the second embodiment as shown in FIG. 6 is the same as the flow chart as shown in FIG. 5, and the explanation on the procedure for the second embodiment is omitted In the second embodiment, only the lower intake air temperature detector 16 is activated on heating, and only the upper intake air temperature detector 15 is activated on cooling, thereby preventing the short cycle effectively.

Now, a third embodiment wherein the principle of the air flow control according to the present invention is applied will be explained in reference to FIGS. 7 through 10.

Figure 7:
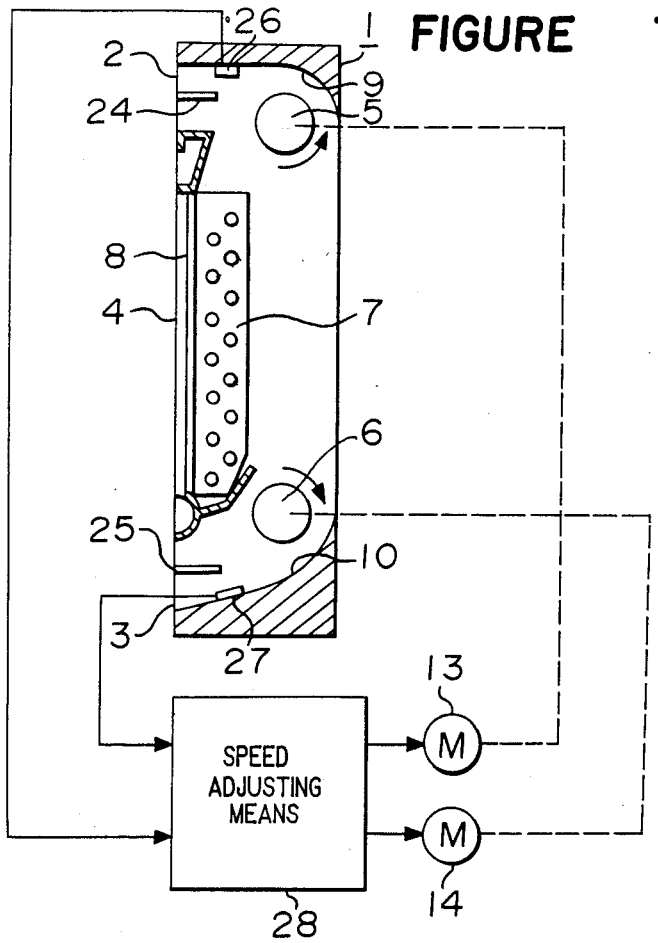
FIG. 7 is a diagram showing the whole arrangement of a third embodiment according to the present invention.

FIG. 7 is a diagram showing the whole arrangement of the third embodiment, wherein the same reference numerals as FIG. 2 indicate similar or corresponding parts. Reference numerals 24 and 25 indicate an upper and lower air directing plate which are arranged in the upper and lower outlet ports 2 and 3 to be capable of changing the flow direction of the condition outlet air. Reference numerals 26 and 27 indicate position sensors for detecting the direction of the upper and lower air directing plates 24 and 25. The position sensors 26 and 27 output an "ON" signal when the direction of each air directing plate 24 or 25 is in the range wherein the short cycle may occur in the conditioned outlet air.

The output signal from the position sensors 26 and 27 is input to fan motor speed adjusting means 28. The speed adjusting means 28 is the same as the speed adjusting means as shown in FIG. 1, and controls the revolution speed of the fans based on the output signal from the position sensors 26 and 27 so as to prevent the short cycle from occuring. The speed adjusting means 28 is connected to the fan motors 13 and 14 for driving the upper and lower fans 5 and 6, respectively.

Figure 8:
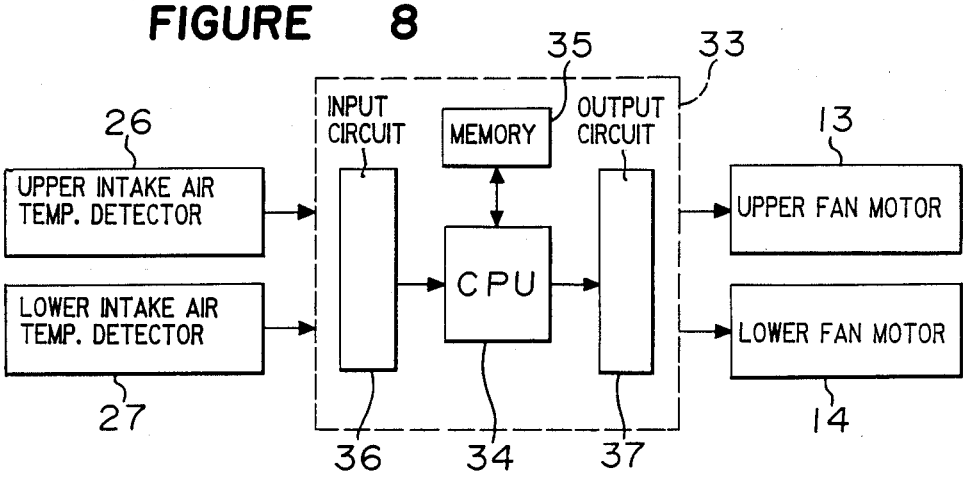
FIG. 8 is a block diagram showing an example of the speed adjusting means in the third embodiment.

FIG. 8 is an example wherein the speed adjusting means 28 is constituted by a microcomputer 33.

In FIG. 8, the microcomputer 33 constituting the speed adjusting means comprises a central processing unit (hereinbelow, referred to as CPU) 34 for controlling the entire system, memory 35 for storing a program for fan motor speed adjusting procedure and other data, an input circuit 36 for transmitting the output signal of the air directing plate position sensors 26 and 27 to the CPU 34, and an output circuit 37 for outputting the data processed by the CPU 34 to the upper and lower fan motors 13 and 14.

Now, the operation of the air flow control device of the third embodiment as constructed above will be described in reference to FIGS. 9 and 10.

Figure 9:
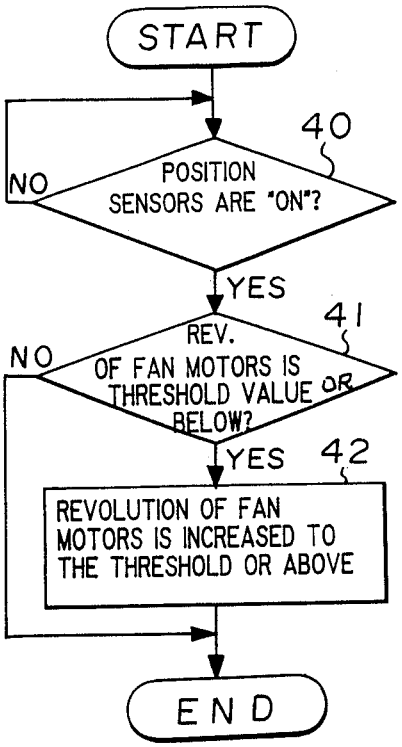
FIG. 9 is a flow chart showing speed adjusting procedure in the third embodiment.

FIG. 9 is a flow chart showing a speed adjusting procedure for the fan motors. FIG. 10 is a graphical representation to explain the range wherein the conditioned outlet air may be in the short cycle in respect with the output signal from the sensors and the revolution of the fan motors.

Firstly, explanation on FIG. 10 will be made.

For example, when the air directing plate 24 is changed from an upward direction to the front direction in the upper outlet port 2, and the flow rate of the conditioned outlet air is a value (hereinbelow, referred to as a thresfold value) or below, the outlet air comes into the range wherein there is a possibility that the short cycle may occur, causing the position sensor 26 to output an "ON" signal. On the other hand, when the air directing plate 25 is changed from a downward direction from the front direction in the lower outlet port 3, and the flow rate of the outlet air is the thresfold value or below, the outlet air comes into the range wherein there is a possibility that the short cycle may occur, causing the position sensor 27 to output the "ON" signal.

When the air conditioner starts heating or cooling, the upper and lower fans 5 and 6 are rotated at a speed corresponding to the heating or the cooling load. As a result, the air in a room to be air-conditioned is suck into the intake port 4, and is heat-exchanged while it is passing through the heat exchanger 7. After that, the conditioned air is blown off into the room from the outlet ports 2 and 3 to air-condition the inside of the room.

On the other hand, the operation of the air conditioner starts a program as shown in FIG. 9. At a step 40, it is monitored whether the position sensor 26 or 27 has become "ON" or not. When the direction of the air directing plate 24 or 25 is in the range wherein the short cycle may occur in the outlet air, the ON signal is output. And, at the next step 41, it is judged whether the revolution of the fan motors 13 and 14 is the thresfold value or below. When the result of the judgement finds that the revolution is the thresfold value or below, the processing proceeds to a step 42, where the revolution of the fan motors 13 and 14 is increased until the flow rate of the outlet air beyond the thresfold value to become free from the short cycle. As a result, the short cycle n the outlet air can be prevented, the temperature distribution in the room is uniformed, and effective heat-exchange is obtained.

Figure 10:
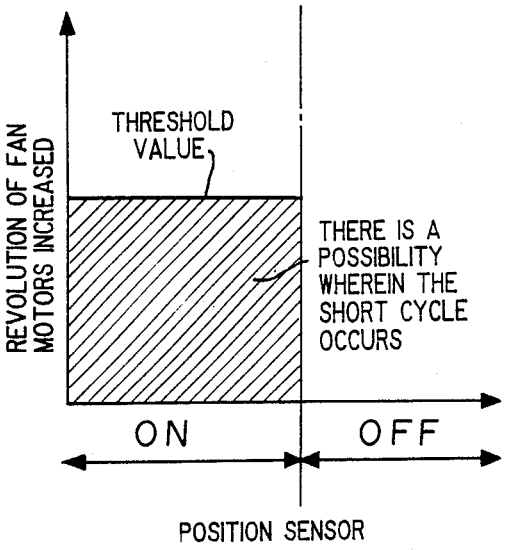
FIG. 10 is a graphical representation showing the relation between the output from a position sensor and the revolution of a fan motor in the third embodiment.

By the way, the short cycle does not always occur in the square entire range as shown in FIG. 10. The range includes a case wherein the short cycle does not occur.

Figure 11:
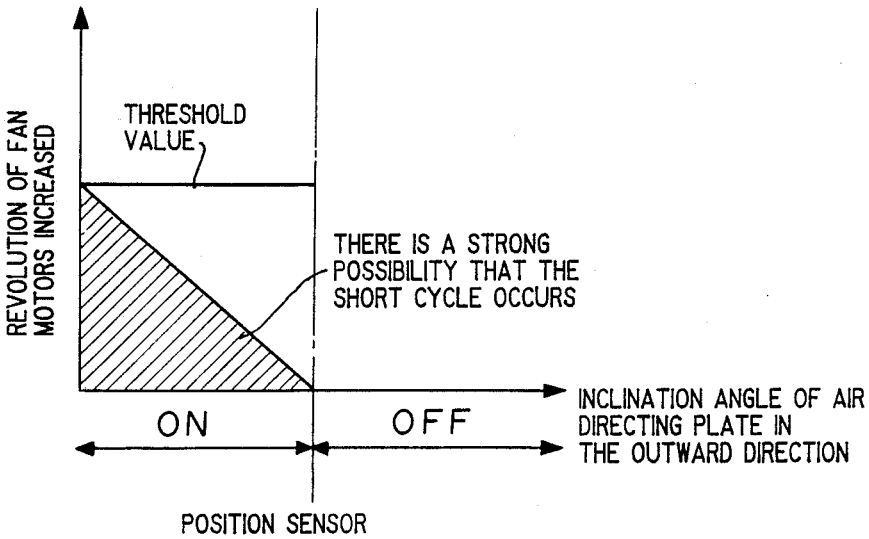
FIG. 11 is a graphical representation to explain the relation between the direction of an air directing plate and the revolution of a fan motor in the third embodiment.

FIG. 11 is a graphical representation wherein the inclination angle of the air directing plates 24 and 25 in the outward directions is added to the horizontal axis in FIG. 10.

In FIG. 11, the range as indicated in FIG. 10 wherein there is a possibility that the short cycle may occur is narrowed down to the range wherein there is a stronger possibility that the short cycle may occur.

The FIG. 11 shows that there is a relation between the revolution of the fan motors and the inclination angle of the air directing plates. That is to say, it is shown that even if the revolution of the fan motors is decreased, the air directing plates can be directed more outwardly to prevent the short cycle from occurring.

On the other hand, when a possibility of causing the short cycle is judged only based on the inclination angle of the air directing plates, it is forced to treat the range as shown in FIG. 10 as the range wherein there is a possibility that the short cycle may occur.

By the way, the first embodiment has been explained on the case wherein when the output signal from the intake air temperature detectors is "ON", the revolution of the fan motors is controlled so as to be increased by one step. When the air flow control device of the first embodiment is provided with means for controlling the air directing plates like the third embodiment, the same effect can be obtained by changing the flow direction of the outlet air to such extend that the short cycle does not occurs in the outlet air.

Now, a fourth embodiment of the present invention wherein the first embodiment is combined with the third embodiment as stated just above will be explained in reference to FIGS. 12 through 14. The same reference numerals as those in FIGS. 2, 4, 5 and 7 indicate similar or corresponding parts in FIGS. 12 through 14, and the explanation on those parts will be omitted.

Figure 12:
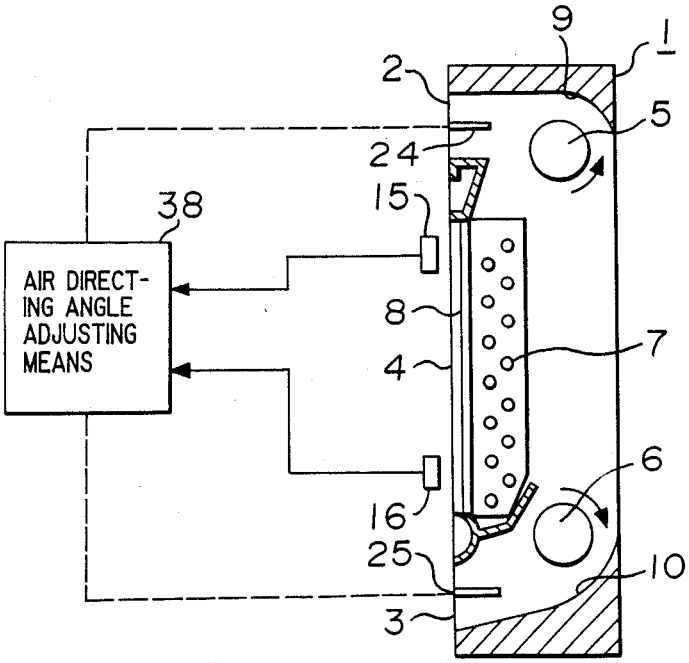
FIG. 12 is a diagram showing the whole arrangement of a fourth embodiment according to the present invention.

FIG. 12 is a diagram showing the whole arrangement in the air conditioner of the fourth embodiment wherein the principle of the air control according to the present invention is applied.

In FIG. 12, reference numeral 38 designates air directing angle adjusting means for adjusting the air directing angle of the air directing plates 24 and 25 based on the output signal from the upper and lower intake air temperature detectors 15 and 16.

Figure 13:
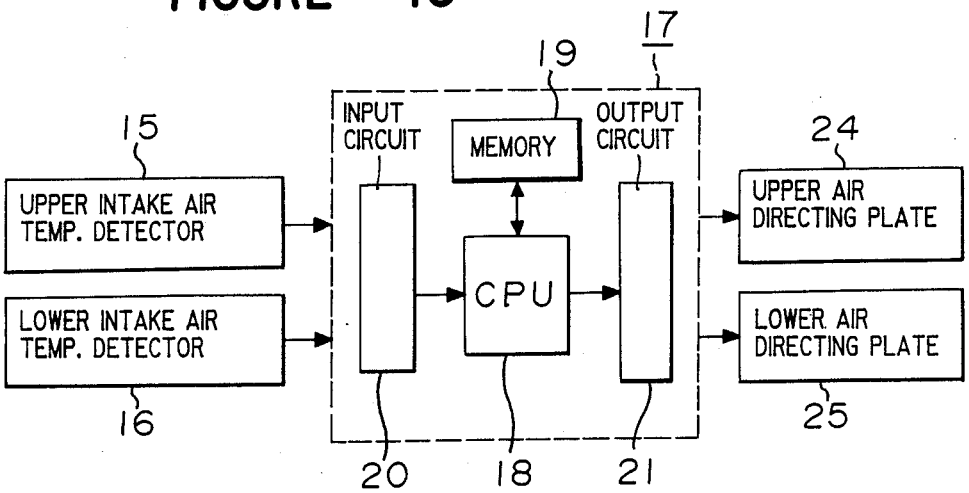
FIG. 13 is a block diagram showing means for adjusting the direction of an air directing plate in the fourth embodiment.
Figure 15:
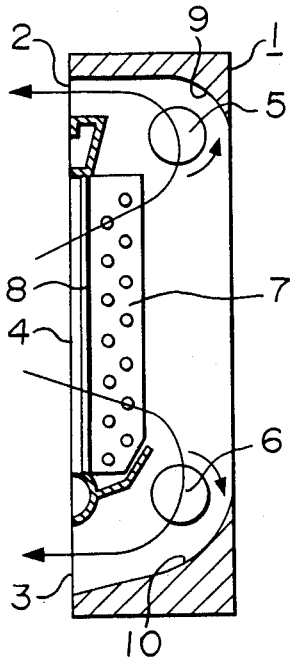
FIG. 15 is a vertical cross-sectional view showing the indoor unit for a conventional air conditioner.

FIG. 13 shows an example wherein the air directing angle adjusting means is constituted by a microcomputer 17.

In FIG. 13, the microcomputer 17 constituting the air directing angle adjusting means comprises a central processing unit (hereinbelow, referred to as CPU) 18 for controlling the entire system, memory 19 for storing a program for air directing angle adjusting procedure and other data, an input circuit 20 for transmitting the output signal from the upper and lower intake air temperatures 15 and 16 to the CPU 18, and an output circuit 21 for outputting the data processed in the CPU 18 to the upper and lower air directing plates 24 and 25.

Figure 14:
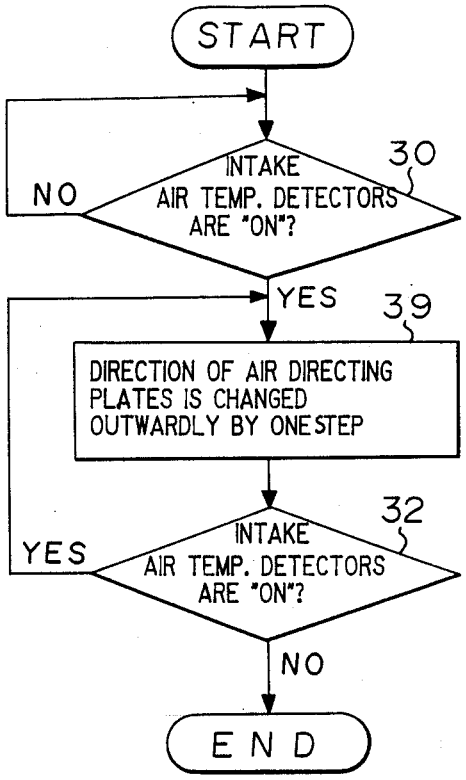
FIG. 14 is a flow chart showing direction adjusting procedure in the fourth embodiment.
Figure 16:
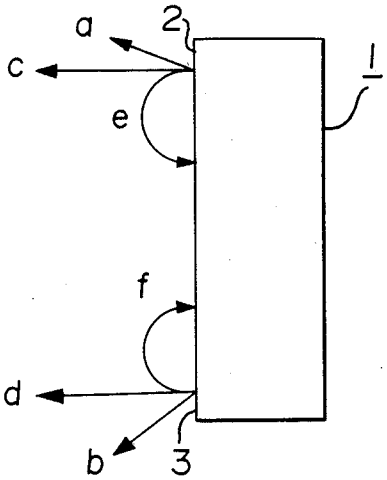
FIG. 16 is a diagram to explain the state wherein outlet air is blown off.

Now, the operation of the air flow control device of the fourth embodiment will be described in reference to a flow chart as shown in FIG. 14.

When the air conditioner starts heating or cooling, the upper and lower fans 5 and 6 are rotated at a speed corresponding to the heating or cooling loads As a result, the air in a room to be air-conditioned is sucked into the intake port 4, it is subjected to heat-exchange while passing through the heat exchanger 7. After that, it is blown off from the outlet ports 2 and 3 into the room to air-condition the inside of the room.

On the other hand, the operation of the air conditioner starts the program as shown in FIG. 14. Firstly, at a step 30, it is monitored whether the intake air temperature detector 15 or 16 has become "ON". If the outlet air from the outlet ports 2 and 3 is in the short cycle wherein a part of the outlet air turns to the intake port 4 due to, e.g. the switching of the fans 5 and 6 to a low speed revolution, the outlet air in the short cycle is detected by the intake air temperature detectors 15 and 16. When the intake air temperature is the set temperature $T_2$ or above (on heating), or the set temperature $T_1$ or below (on cooling) for the temperature detectors 15 and 16 at that time, the intake air temperature detectors 15 and 16 output an ON signal indicating that there is a strong possibility that the short cycle may occur in the outlet air.

When the ON signal is received into the CPU 19 through the input circuit 20, the direction of the upper and lower air directing plates 24 and 15 is changed outwardly by one step according to the program for air directing angle adjusting procedure as stored in the memory (at a step 39). At the step 39, the direction of the air directing plates may be changed to a preset angle instead of changing the direction of the air directing plates by one step. And, the processing proceeds to the next step 32, where it is judged again whether the intake air temperature detector 15 or 16 transmits the ON signal. When the ON signal is transmitted, the processing returns to the step 39, where the direction of the air directing plates 24 and 25 is changed outwardly by one more step.

After that, the direction of the air directing plates 24 and 25 is successively changed outwardly by one step until it has been judged that the intake air temperature detectors 15 and 16 have become off, i.e. that the short cycle does not occur in the outlet air. When the intake air temperature detectors 15 and 16 become off, the short cycle procedure for the outlet air terminates.

In accordance with the fourth embodiment of the present invention, the intake air temperature detectors 15 and 16 judge whether the short cycle occurs in the outlet air or not. When it is considered that the outlet air comes into the short cycle, the direction of the air directing plates is automatically changed outwardly to eliminate the short cycle, thereby preventing the temperature distribution in the room from deteriorating and maintaining effective heat-exchange.

By the way, there is a stronger possibility that the short cycle occurs in the air blown off from the lower outlet port 3 on heating in comparison with the air blown off from the upper outlet port 2, because the blown air, i.e. air lighter than the air in the room is blown off from the outlet ports. As a result, even if, on heating, only the intake air temperature detector 16 is activated to control both upper and lower air directing plates 24 and 25, or only the lower air directing plate 25 is controlled based on the output signal from the lower intake air temperature detector 16, the short cycle can be prevented effectively.

On the other hand, there is a stronger possibility the short cycle may occur in the air blown off from the upper outlet port 2 on cooling in comparison with the air blown off from the lower outlet port 3, because the cooled air, i.e. air heavier than the air in the room is blown off from the outlet ports. As a result, even if, on cooling, only the upper intake air temperature detector 15 is activated to control for both upper and lower air directing plates 24 and 25, or only the upper air directing plate 24 is controlled based on the output signal from the upper intake air temperature detector 15, the short cycle can be prevented effectively.

Since most of the recent air conditioners are manufactured so that the air directing plates can be automatically operated, the device of the fourth embodiment does not necessarily raise the cost.

We claim:

1. An air flow control device for an air conditioner having an outlet port and an intake port formed in an indoor unit main body, and having a fan motor arranged so as to face the outlet port, comprising:

detecting means for detecting information corresponding to a possibility that the outlet air blown out off an outlet port is blown into the intake port, and fan motor speed adjusting means for controlling the revolution of the fan motor based on the output signal from the detecting means.

2. An air flow control device according to claim 1, wherein the detecting means is constituted by a temperature detector for detecting the inlet air temperature, whereby the temperature detector transmits an output signal to the fan motor speed adjusting means when it detects a temperature that is a set value or above.

3. An air flow control device according to claim 1, wherein the revolution of the fan motor is increased by one step when the detecting means sends the output signal.

4. An air flow control device according to claim 1, wherein the revolution of the fan motor is increased to a preset thresfold value or above when the detecting means sends the output signal.

5. An air flow control device according to claim 1, wherein the outlet port is formed in an upper portion and a lower portion of the indoor unit main body.

6. An air flow control device according to claim 5, wherein the fan motors are arranged so as to face the upper and lower outlet ports, respectively.

7. An air flow control device for an air conditioner having an outlet port and an intake port formed in an indoor unit main body, having a fan motor and an air directing plate arranged so as to face the output port, comprising:

detecting means for detecting information according to a possibility that the outlet air blown out off the outlet port is blown into the intake port; and fan motor speed adjusting means for controlling the revolution of the fan motor based on the outlet signal from the detecting means.

8. An air flow control device according to claim 7, wherein the detecting means is constituted by a position sensor for detecting the direction of the air directing plate in the outlet port, whereby it sends the output signal to the fan motor speed adjusting means when it detects that the direction of the air detecting plate is a thresfold value or below.

9. An air flow control device according to claim 7, wherein the revolution of the fan motor is increased by one step when the detecting means sends the output signal.

10. An air flow control device according to claim 7, wherein the revolution of the fan motor is increased to a preset thresfold value or above when the detecting means sends the output signal.

11. An air flow control device according to claim 7, wherein the outlet port is formed in an upper portion and a lower portion of the indoor unit main body.

12. An air flow control device according to claim 11, wherein the fan motors are arranged so as to face the upper outlet port and lower outlet port, respectively.

* * * * *